United States Patent [19]

Lappage

[11] 4,150,838

[45] Apr. 24, 1979

[54] WHEELED CARRIAGE FOR RECREATIONAL PURPOSES

[76] Inventor: Colin R. Lappage, 26 Church Hill, Coleshill, Birmingham, England, B46 3AJ

[21] Appl. No.: 845,306

[22] Filed: Oct. 25, 1977

[51] Int. Cl.[2] ..... B62K 9/00

[52] U.S. Cl. ..... 280/87.04 A; 280/11.1 BR

[58] Field of Search ..... 280/87.01, 87.04 R, 280/87.04 A, 47.31, DIG. 7, 11.1 BT, 11,1 BR; 301/7; 152/375

[56] References Cited

U.S. PATENT DOCUMENTS

| | | | |
|---|---|---|---|
| 1,336,100 | 4/1920 | Shearer | 280/87.04 R |
| 3,339,940 | 9/1967 | Anthony | 280/87.01 |
| 3,671,055 | 6/1972 | Aarup | 280/87.04 A |
| 3,826,511 | 7/1974 | Frank | 280/47.31 |
| 3,856,321 | 12/1974 | Solymosi | 280/87.04 A |

*Primary Examiner*—John A. Pekar

*Assistant Examiner*—R. Schrecengost

*Attorney, Agent, or Firm*—Scrivener, Parker, Scrivener & Clarke

[57] ABSTRACT

A wheeled carriage for recreational purposes comprising a platform large enough for a person to stand on with his or her feet side by side, and a single front wheel and a single rear wheel mounted to said platform so as to be capable of rotation about spaced parallel axes and with the centers of the wheels lying in the longitudinal vertical central plane of said platform, the wheels being of rounded profile to enable the platform to tilt laterally in use, the platform being offset above or below the axes of the wheel, whereby the carriage can be used either way up, the platform being above the wheel axis when the carriage is one way up so as to require a high level of skill to maintain the carriage balanced, and the platform being below the wheel axes when the carriage is the other way up so as to require a lower level of skill to maintain the carriage balanced.

9 Claims, 5 Drawing Figures

WHEELED CARRIAGE FOR RECREATIONAL PURPOSES

Figure 1:
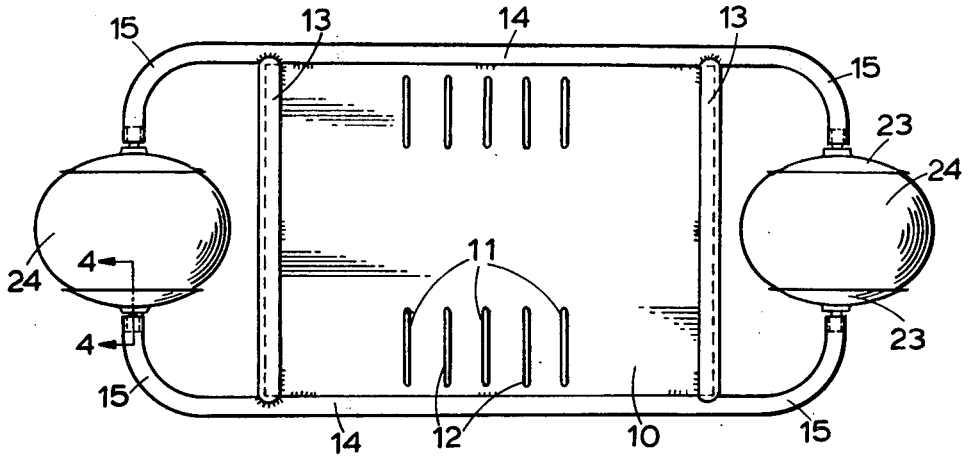

This invention relates to a wheeled carriage for recreational purposes.

From one aspect the present invention consists in a wheeled carriage for recreational purposes comprising a platform large enough for a person to stand on with his or her feet side by side, and a front wheel and a rear wheel mounted for rotation about spaced parallel axes, the wheels being of rounded profile to enable the platform to tilt laterally in use.

The platform is normally at least twelve inches wide and is preferably at least fifteen inches wide; it would normally be no greater than twenty four inches, and preferably it is no more than twenty inches wide.

It is intended that the user should stand on the platform with his or her feet on either side of the imaginery line joining the centres of the wheels, and should balance himself or herself as the carriage moves forward. It is found that the type of balancing skill involved is somewhat similar to that required in skiing, so that the carriage may be used in training skiers or as a substitute for skiing. The user may employ guide sticks similar to ski-sticks, to assist the user to retain his or her balance, to assist the user guiding and propelling the carriage forward. In a preferred arrangement the guide sticks can be releasably attached to the carriage so as to enable the user to tow the carriage when it is not in use.

The carriage may be used on any suitable surface, but is particularly intended for use on a grass slope.

The platform may be on substantially the same level as the wheel axes, but in a preferred construction the platform is offset above or below the wheel axes, the arrangement preferably being such that the carriage can be used either way up, the platform being above the wheel axes when the carriage is one way up, and the platform being below the wheel axes when the carriage is the other way up.

The platform may be large enough for the user to sit on; in practice it is found that a seated user can quite readily balance the carriage when the platform is below the level of the wheel axes.

The axes of the wheels may be fixed, the wheels rotating about spaced axes parallel with each other and with the platform, and normal to the imaginary line joining the centres of the wheels. In a modified construction the front wheel is steerable; to this end it may be mounted so that its axis can turn about a vertical axis or an axis inclined to the vertical. In that case steering means, such as a tiller bar, may be provided, or the front wheel may be mounted in such a manner that its axis moves in response to tilting movement of the carriage. In either instance the carriage may still be capable of being used either way up, though provision may be necessary for some adjustment of the steering means when the carriage is inverted.

When the user steps on the platform preparatory to its moving, the carriage is normally inclined laterally so that one side edge of the platform bears on the ground. In order to prevent the user's feet slipping sideways off the platform it is preferred to provide upstanding stop means along at least one side edge of the platform.

From another aspect the present invention consists in, for a wheeled carriage of the kind outlined above, a platform large enough for a person to stand on with his or her feet side by side, and rotatable mounting means at the front and at the rear of the platform, the mounting means being capable of receiving preformed resilient balls so as to constitute with such balls front and rear wheels.

Figure 2:
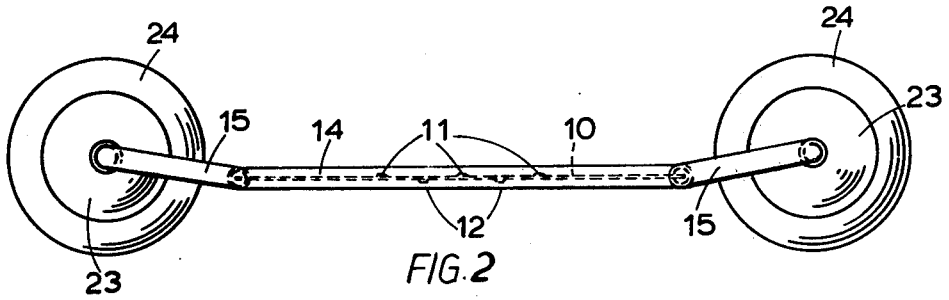
Figure 3:
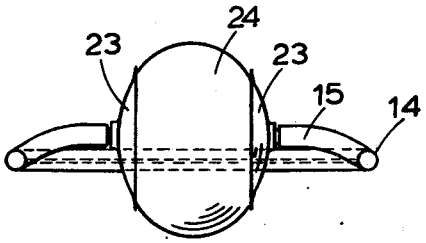
Figure 4:
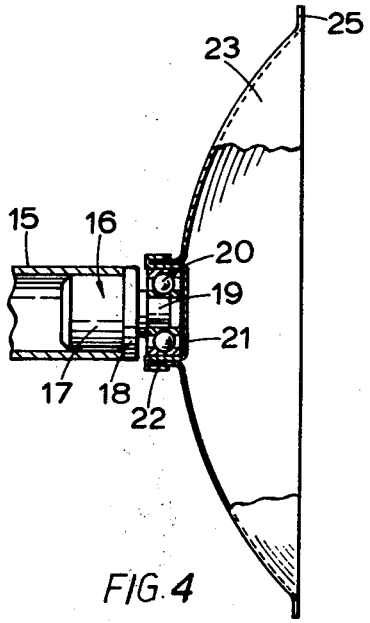
Figure 5:
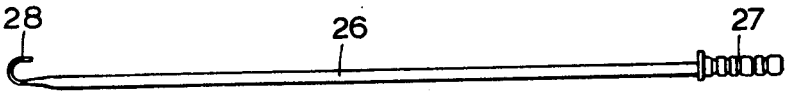

An embodiment of the invention will now be described in more detail, by way of example, with reference to the accompanying drawings, in which:

FIG. 1 is a plan view of a wheeled carriage embodying the present invention, FIG. 2 is a side view of the carriage shown in FIG. 1, FIG. 3 is an end view of the carriage shown in FIG. 1, FIG. 4 is a section, to a larger scale, along the line 4—4 of FIG. 1, and FIG. 5 shows on of a pair of similar sticks for use with the carriage shown in FIGS. 1 to 4.

The carriage illustrated in the accompanying drawings comprises a base plate 10 made from a rectangular piece of sheet metal. Ribs 11 and grooves 12 are formed in the base plate, their shapes being such that the formations which constitute ribs on one face of the base plate constitute grooves on the other face thereof. The ribs and grooves are mutually parallel and extend in a transverse direction parallel with the shorter edges of the base plate. The ribs and grooves extend inwards, towards the longitudinal centre line of the base plate from points adjacent to the longer edges of the base plate. There is a set or group of alternating ribs and grooves extending forwards and rearwards from the transverse centre line of the base plate. The ribs and grooves serve to provide some grip for the soles of the shoes worn by the user, and they also serve to strengthen the base plate.

The base plate 10 is mounted within a peripheral frame made of metal tubes. Two end tubes 13 extend along the front and rear edges of the base plate. The tubes 13 are slit longitudinally, and the marginal parts of the base plate enter the tubes through the slits and are welded in place. Two side tubes 14 extend along the two sides edges of the plate, and have integral extensions 15 which extend beyond the edges of the plate. The side edges of the plate 10 are welded to the side tubes 14, and the ends of the end tubes 13 are shaped to receive the side tubes 14 and are also welded to the side tubes.

The main central parts of the side tubes 14 lie in a horizontal plane, but the extensions 15 at each end of the side tubes are bent upwards to lie in a plane inclined at 5° to the horizontal. The end part of each extension 15 is bent into the shape of a quarter of a circle so as to face the end of the adjacent extension.

A metal fitting 16 is secured to the end of each extension. Each fitting has a spigot 17 which projects into the open end of the tubular extension, a flange 18 which abuts the end of the extension, and a spindle 19 which is co-axial with the spigot and flange and projects into a ball bearing 20. The ball bearing is itself mounted in a sheet metal housing 21. The housing 21 is formed in the shape of a short cylindrical sleeve closed at one end by a circular disc and having an outwardly turned flange at the other end. The flange is initially formed as a planar, annular flange, but during assembly the sleeve of the housing 21 is fitted into a collar 22 projecting axially from a dish 23 and the flange is then folded back over the outside of the collar 22, as shown. Thus the collar 22 is trapped between the sleeve and the flange of the housing 21. This arrangement avoids the presence of sharp edges and provides strong reinforcement for the collar 22. The dish 23 is a part-spherical shape, and the collar 22 projects from the centre of its convex side. As will be seen in FIG. 1 there are at each end of the carriage two freely rotatable dishes 23 disposed co-axially and with their concave faces directed towards each other.

A resilient ball 24 is disposed between each pair of dishes, and with the dishes serves as a wheel. In a preferred construction each ball is of the inflatable kind. The ball may comprise a spherical football or a ball of dimensions similar to those of a football. A standard British football is between 27 inches and 28 inches in circumference. Many plastics balls of this kind are currently on the market and are suitable for use. Typical balls are made as blow-mouldings from polyproylene. Larger or smaller balls may of course be used, though the balls are preferably no greater than 10 or 12 inches in diameter or no less than 6 or 8 inches in diameter. During assembly the uninflated ball is placed between the dishes 23 and is inflated in situ. The arrangement is such that the space between the dishes is rather less than the normal diameter of the ball, the result being that the ball assumes a shape which approximates to that of an oblate spheroid, presses against the dishes due to its resilience and is thus held in place. The dishes are preferably shaped so that when the ball is in place between them the surface of the ball is in contact with the entire concave surface of each dish and there is no local change in curvature at the edge of the dish. Nevertheless, if desired the dishes may have holes formed in them, for example each dish may be formed with a ring of equally spaced circular holes, the ring being centred on the axis of the dish. This reduces the weight of each dish and the amount of metal used.

When the carriage is in use the balls will of course be distorted locally due to the loading on the carriage. In order to reduce the likelihood of the edges of the dishes 23 damaging the balls the margins of the dishes are turned outwards as indicated at 25, to provide rounded edges for engagement with the balls. To assist in stabilising the positions of the balls 24 and to reduce the likelihood of their being knocked out of place an adhesive or a viscous substance may be introduced between the balls and the dishes. For example known adhesives of the latex kind while not adhering firmly to the metal dishes or to the plastics balls may be used to provide increases resistance to movement.

The carriage may be used either way up, and the user may stand or sit on the platform. If he or she is to stand on the platform the presence of the side tubes 14 of the peripheral frame prevents his or her feet sliding off the base plate 10 when he or she steps onto the base plate; the side tubes thus constitute upstanding stop means of the kind referred to above.

A pair of sticks may be provided to assist the user. A typical form of stick is shown in FIG. 5. Each stick comprises a metal tube 26 about 40 inches long with a plastics or rubber hand-grip 27 fitted over one end and with the other end flattened and bent to form a semi-circular hook 23. The tube 26 may conveniently be made of aluminium. In use the rounded ends of the sticks engage the ground when the sticks are used to stabilise or propel the carriage; then, when the user wishes to tow the carriage, as may be necessary when returning to the top of a sloping run, the hooked ends 28 of the sticks can be hooked onto the end portions of the extension 15 of the side tubes, on either side of the front wheel, and the carriage can be towed by the sticks.

A typical carriage of the kind described above has a base plate about 22½ inches long and 16 inches wide, the distance between the wheel axes being 36 inches. The minimum ground clearance is a little more than 3½ inches, and the diameter of the open mouths of the dishes is about 6½ inches.

The carriage is described above as if it were in the position shown in the accompanying drawings and standing on a horizontal surface ready for use. It must be understood, though, that the carriage may equally well be inverted so that the plane in which the base plate 10 lies is above the plane containing the axes of the two wheels rather than below that plane.

Many modifications may be made. For example the straight end tubes 13 may be replaced by end tubes shaped approximately like the letter U, extending around the wheels, the base plate 10 being correspondingly extended on either side of each wheel. Slots may then be provided in the base plate to receive the hooked ends 23 of the sticks. In another modification the base plate 10 lies in the plane of the wheel axes and there is thus no significant alteration when the carriage is inverted. Instead of its being fabricated from metal parts the carriage may be largely or wholly made from a plastics material. As to the wheels the simple inflatable balls 24 may be replaced by uninflated balls each made from two plastics shells of hemispherical shape secured together at their peripheries and each having an integral axis tube projecting into its interior; a metal spindle extends through the aligned tubes and constitutes an axle for the ball.

I claim:

1. A wheeled carriage for recreational purposes comprising a platform large enough for a person to stand on with his or her feet side by side, and a single front wheel and a single rear wheel mounted to said platform so as to be capable of rotation about spaced parallel axes and with the centers of the wheels lying in the longitudinal vertical central plane of said platform, the wheels being of rounded profile to enable the platform to tilt laterally in use, the platform being offset above or below the axes of the wheel, whereby the carriage can be used either way up, the platform being above the wheel axes when the carriage is one way up so as to require a high level of skill to maintain the carriage balanced, and the platform being below the wheel axes when the carriage is the other way up so as to require a lower level of skill to maintain the carriage balanced.

2. A wheeled carriage according to claim 1 in which the axes of the wheels are fixed, the wheels rotating about spaced axes parallel with each other and with the platform, and normal to the imaginary line joining the centres of the wheels.

3. A wheeled carriage according to claim 1 in which the platform comprises a base plate with a peripheral tubular frame.

4. A wheeled carriage according to claim 1 in which the wheels comprise preformed inflatable balls retained between rotatable concave discs.

5. A wheeled carriage according to claim 1 in which the front wheel is so mounted as to project forward in front of any other part of the carriage.

6. A wheeled carriage according to claim 1 in which there is provided stop means operative in use, when the carriage is one way up or is the other way up, to prevent the user's feet sliding laterally off the platform when the carriage is at rest.

7. A wheeled carriage according to claim 3 in which the peripheral tubublar frame includes a tube part extending along one side edge of the plate and a tube part extending along the other side edge of the plate, each tube part extending both above and below the level of the plate to provide stop means operative in use when the carriage is either way up to restrain a user against sliding laterally off the platform and to engage the ground when the carriage tilts in excess of a predetermined amount.

8. A wheeled carriage according to claim 1 in combination with a pair of guide sticks, the guide sticks having hook formations whereby they can be releasably attached to the carriage to enable it to be towed when not in use, but which can be detached from the carriage when the carriage is to be used.

9. A wheeled carriage for recreational purposes comprising a platform large enough for a person to stand on with his or her feet side by side, and mounting means at the front and at the rear of the platform, and rotatable about spaced parallel axes, the mounting means being constructed and arranged to receive single preformed resilient balls at the respective front and rear of the platform so as to constitute with such balls front and rear wheels rotatable about said axes, with the centers of the wheels lying in the longitudinal vertical central plane of the platform, the platform being offset above or below said axes, whereby the carriage can be used either way up, the platform being above the axes when the carriage is one way up and being below the axes when the carriage is the other way up.

* * * * *